United States Patent [19]

Gallone

[11] Patent Number: 4,532,390

[45] Date of Patent: Jul. 30, 1985

[54] DIAPHRAGM PRESSURE SWITCH FOR CONTROLLING SMALL PRESSURE GRADIENTS

[75] Inventor: Cesare Gallone, Cornaredo, Italy

[73] Assignee: Signal Lux S.p.A., Milan, Italy

[21] Appl. No.: 551,682

[22] Filed: Nov. 14, 1983

[30] Foreign Application Priority Data

Nov. 17, 1982 [IT] Italy ..... 24290 A/82
May 30, 1983 [IT] Italy ..... 21996/83[U]

[51] Int. Cl.[3] ..... H01H 35/40

[52] U.S. Cl. ..... 200/83 B; 200/83 N; 200/83 S

[58] Field of Search ..... 200/83 R, 83 A, 83 B, 200/83 N, 83 P, 83 Q, 83 S, 83 SA, 83 V, 83 Y, 83 W

[56] References Cited

U.S. PATENT DOCUMENTS

| | | | |
|---|---|---|---|
| 1,840,340 | 1/1932 | White | 200/83 V |
| 2,039,717 | 5/1936 | Hueber et al. | 200/83 N X |
| 2,813,945 | 11/1957 | Courtot | 200/83 V |
| 3,005,067 | 10/1961 | Leibold et al. | 200/83 N |
| 4,104,495 | 8/1978 | Jones et al. | 200/83 S X |
| 4,307,272 | 12/1981 | Dvorachek | 200/83 P |

FOREIGN PATENT DOCUMENTS

| | | | |
|---|---|---|---|
| 1390306 | 1/1965 | France | 200/83 V |

*Primary Examiner*—J. R. Scott
*Attorney, Agent, or Firm*—Darby & Darby

[57] ABSTRACT

A pressure switch for detecting and controlling small pressure gradients in fluid circulation systems includes a containing body having first and second channels formed therein, and an elastically deformable diaphragm. The diaphragm is supported at its edges by the body and separates the first and second channels from each other. A small disc formed of an electrically conductive material cooperatingly engages a portion of one of the faces of the diaphragm. Electrical contacts are supported by the body and disposed adjacent the small disc. The diaphragm is provided with a working portion that is disposed outwardly from the periphery of the small disc and is relatively thin. The pressure switch further includes an annular supporting plug projecting from the containing body and engaging the diaphragm close to the edge of the disc.

13 Claims, 6 Drawing Figures

DIAPHRAGM PRESSURE SWITCH FOR CONTROLLING SMALL PRESSURE GRADIENTS

FIELD AND BACKGROUND OF THE INVENTION

The present invention relates to a diaphragm pressure switch for controlling small pressure gradients.

It is known that there are at present many types of diaphragm pressure switches having different structures which are intended to detect and, or to indicate and, or to automatically counterbalance pressure gradients or rates of rise or fall which may arise in different circuits or apparatuses.

The common element of these pressure switches is a diaphragm separating two adjacent chambers each of them being in communication with a specific area of the apparatus or circuit to be controlled. The diaphragm is subject to deformation in a manner substantially proportional to the rate of rise or fall of pressure which may occur between the two chambers mentioned above and by its deformations it actuates suitable detecting and, or controlling members. Typically, the diaphragm draws along one or more electrically conductive elements and by said deformation arranges the same so that some electrical contacts are connected to one another. These are connected, for example, to warning lights or to stop members for the devices which may have cause said variation in pressure.

The most important technical drawback of these pressure switches resides in that they are not in a position to detect very small pressure gradients such as for example of a few millibars if they have a small size and a comparatively simple structure. Furthermore, when the diaphragm pressure switches of the kind mentioned above have to detect very small pressure gradients, they appear very irregular and are not sure in operation, which considerably reduces their reliability particularly as to the possibility of constant detections during a long lapse of time. That is a technical disadvantage from a general point of view as it reduces the possibility of applying pressure switches of the kind mentioned above to all usual apparatuses, home apparatuses included, for which said pressure switches woulld be particularly useful.

For example, it would be possible to control the degree of operation of a vacuum cleaner due to the clogging of the filter-bag, or the operation of a hood, or still to control the level of various tanks by using small diaphragm pressure switches simply connected to warning lights suitable to inform any utilizer of an irregularity in operation.

Practical tests have proved that known pressure switches are not suitable for working environments where polluting factors such as dust, hydrocarbon vapors and the like exist, which may hinder the passage of current close to the electrical contacts. It is the same when they are introduced into a working fluid, such as for example some kinds of oils, which has a partial insulating power.

OBJECTS

It is therefore a technical task of the present invention to provide a diaphragm pressure switch for controlling small pressure gradients provided with a very high sensibility and reliability, having a very simple structure and suitable to be produced by the industries operating in this field, at a low production cost.

Within the scope of this technical task it is an important object of the present invention to provide a diaphragm pressure switch having considerably small dimensions so that it can easily be inserted into various circuits and devices.

A further important object of the invention is to provide a pressure switch adapted to work in whatever environment or working fluid without being damaged.

SUMMARY OF THE INVENTION

The above mentioned objects are substantially attained by a diaphragm pressure switch for controlling small pressure gradients comprising, in a containing body communicating with the outside by means of channels: a diaphragm subject to elastic deformation, supported at its edges by said body and separating said channels from each other, at least a small disc made of electrically conductive material engaged at least by contact with one of the faces of said diaphragm, and electrical contacts supported by said body and disposed adjacent said small disc, characterized in that said diaphragm is provided with a working portion disposed outwardly with respect to the area of the same diaphragm in contact with said small disc and presenting a thin thickness, and in that supporting and guiding members for said diaphragm are provided at least in correspondence of said body for the purpose of preventing irregular deformations of said working portion.

Further features and advantages will become more apparent from the description of preferred embodiments of the invention, given hereinafter by way of example only, with reference to the accompanying drawings.

DESCRIPTION OF THE PREFERRED EMBODIMENTS

Figure 1:
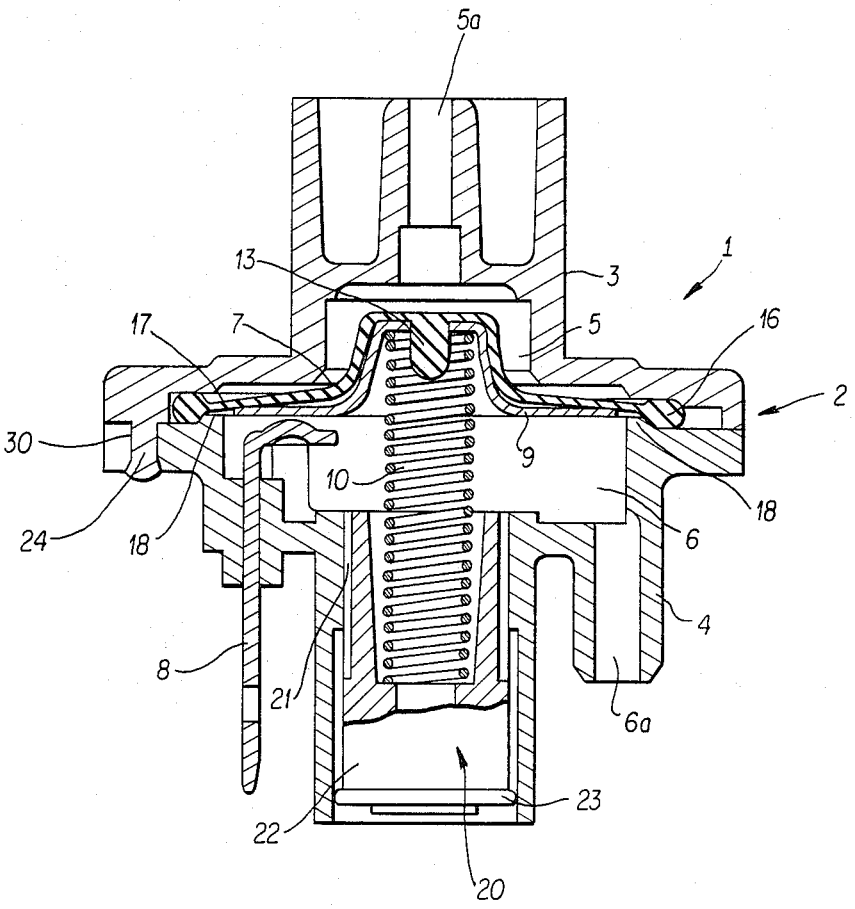
FIG. 1 is a cross-sectional view, taken along line I—I of FIG. 2, of the pressure switch according to the invention.

Referring to the embodiment shown in FIGS. 1 to 4, the diaphragm pressure switch according to the invention is generally indicated at 1. Briefly it comprises a body or shell 2 defined by two half-shells which can be tightly engaged with each other: a first half-shell 3 and a second half-shell 4. At the inside of body 2 the half-shells 3 and 4 define a first chamber 5 and a second chamber 6 respectively, sealingly separated from each other by a working diaphragm 7.

The first and second chambers 5 and 6 are in communication with the outside by means of first and second channels, 5*a* and 6*a* respectively, issuing out in spaced relationship from each other. Furthermore, the second chamber 6 is provided with electrical contacts 8 leading to the outside of body 2. The electrical contacts 8 can be connected to one another by means of a small metal disc 9 associated with the diaphragm 7. In addition, always referring to the embodiment shown in FIGS. 1 to 4, the second chamber 6 is crossed by a compression spring 10.

Figure 3:
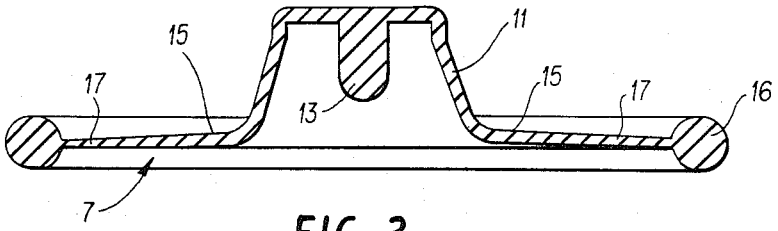
FIG. 3 shows in a sectional view the structure of the diaphragm of the pressure switch as seen in FIG. 1.
Figure 2:
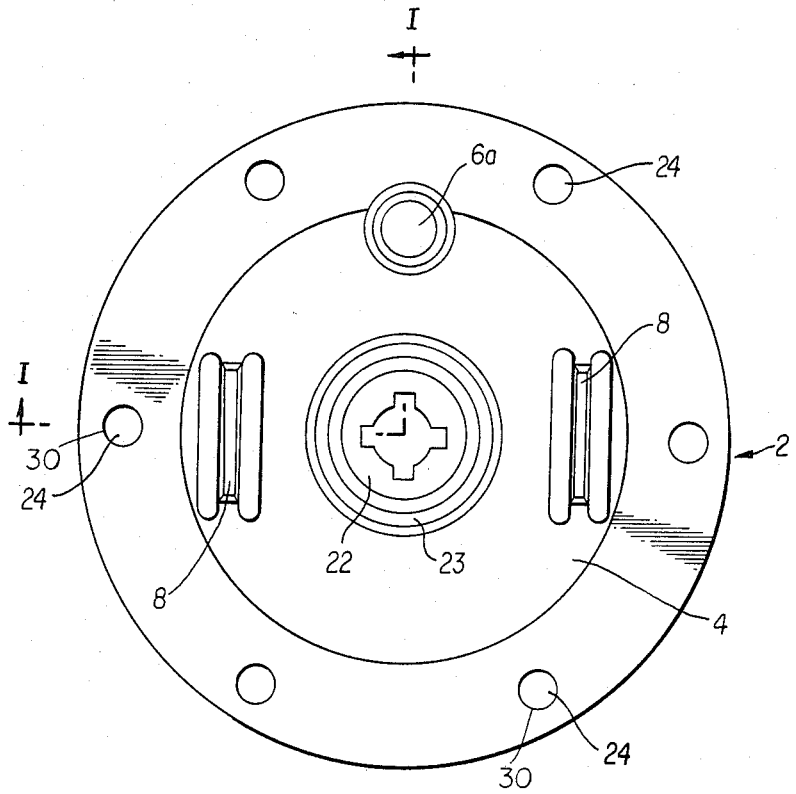
FIG. 2 is a bottom view of the pressure switch shown in FIG. 1.
Figure 4:
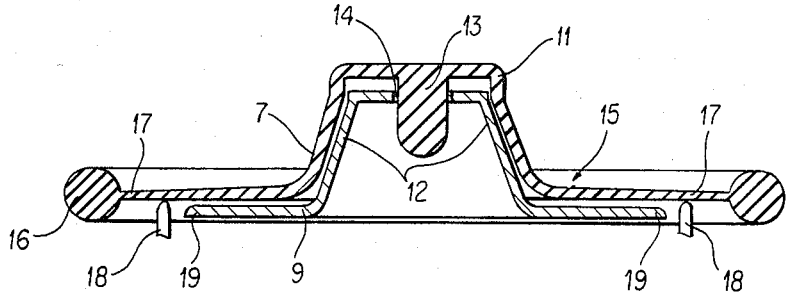
FIG. 4 is a diagrammatic view of the members causing the operation of the pressure switch, taken separately.

Advantageously, as shown in FIG. 3, diaphragm 7 has a central portion 11 substantially dome-shaped and counter-shaped to the central portion 12 of the small disc 9. The central portion 11 of diaphragm 7 is also provided with a substantially pin-shaped projection 13 designed to be fitted into a central hole 14 of the small disc 9.

The edges of the central portion 11 of diaphragm 7 continue with a disc-shaped portion 15 which gets gradually thinner up to a toroidally shaped edge swelling 16. The thinnest part of the disc-shaped portion 15 is situated between the edge 19 of the small disc 9 and the edge swelling 16 and defines, in diaphragm 7, a working portion 17 which is particularly responsive to the stresses applied to the diaphragm itself. FIG. 1 shows that diaphragm 7 is sealingly clamped between the half-shells 3 and 4 directly close to its edge swelling 16.

Furthermore, diaphragm 7 is kept in contact with disc 9 not only by the introduction of projection 13 in hole 14, the main function of which is to assure the centering thereof, but also by means of spring 10 which is inserted into the central dome-shaped portion 12 of disc 9 thereby thrusting the latter against the corresponding central portion 11 of diaphragm 7.

Advantageously supporting and guiding members for diaphragm 7 are provided for the purpose of substantially preventing all irregular deformations of the whole diaphragm in general and of the working portion 17 in particular.

These supporting and guiding members are accomplished by the restrained engagement of the central portion 11 on the central area 12, without glueing, by the radial sizes of the small disc 9 and particularly by the presence of an annular supporting lug 18 projecting from the second half-shell 4 close to the edge swelling 16. In fact, as diagrammatically shown in FIG. 4, the annular supporting lug 18 isolates, on the working portion 17 of diaphragm 7, the portion of the same which is close to the edge swelling 16.

Preferably the part of the working portion 17 which is between the annular supporting lug 18 and the edge 19 of the small disc 9 has well defined sizes: the ratio between the diameter of the small disc 9 and the inner diameter of the annular supporting lug 18 is equal to or more than 0.9. Furthermore, it is preferably provided that the ratio between the diameter of the small disc 9 and that of the disc-shaped portion 15 contiguous to the edge swelling 16, should be equal to or less than 0.8.

It should also be noted that the working portion 17 of diaphragm 7 has a thickness of 0.2 mm and that the diaphragm is made from a silicone elastomeric material.

FIG. 1 further shows that the end of spring 10 opposite to that inserted into the central portion 12 of the small disc 9 is housed within a hollow cup-shaped element 20 provided on the outer surface thereof with a screw-threaded portion 21 fitted in the second half-shell 4 and with an expanded portion 22, which is a continuation of the screw-threaded portion 21 and is provided at its end with a lip 23 allowing a sealing engagement with the second half-shell 4.

The closing of body 2 is completed by pins 24 which are fixedly inserted into slots 30 formed in said half-shells 3 and 4.

The operation of the diaphragm pressure switch according to the embodiment described above is as follows.

The body or shell 2 is arranged closed and channels 5*a* and 6*a* are separately connected to the areas to be controlled, as to their pressure gradient. In particular, the first channel 5*a* is connected to the area which is supposed to have a higher pressure than the one to which the second channel 6*a* is connected.

At the assembling, spring 10 keeps the small disc 9 separated from contacts 8 and the action of spring 10 can be adjusted in a very precise manner acting upon the screwing degree of the cup-shaped element 20. The pressure switch sealing is assured by the screw engagement of the cup-shaped element 20 with the second half-shell 4, by the presence of lip 23 acting between the cup-shaped element 20 and the second half-shell 4, as well as by the presence of the edge swelling 16 of diaphragm 7 clamped between the half-shells 3 and 4.

When an overpressure occurs in the first chamber 5 with respect to the second chamber 6, diaphragm 7 elastically deforms till the small disc 9 is brought on contacts 8, so that suitable detecting or controlling members are actuated.

The elastic deformation of diaphragm 7 is very precise and regular being guided, when deforming, by the annular supporting lug 18, disposed closely adjacent the edge 19 of disc 9. This result can be reached also owing to the exact centering existing between the small disc 9 and diaphragm 7, due to the presence of the projection 13, as well as to the absence of further elements, such as for example glue, between the small disc 9 and the diaphragm 7.

A variant of the pressure switch according to the invention generally indicated at 100 will now be described with reference to FIG. 5. The pressure switch 100 comprises a body 101 divided into three portions: a central portion 102 and two end portions, identified at 103 and 104 respectively. Portions 102, 103 and 104 are seamed together by means of a central collar 105.

The first end portion 103 has a first coaxial channel 106 issuing into an inner expansion chamber 107 of body 101. As shown in the drawing, the first channel 106 is partially threaded. The second end portion 104 is provided with a second channel 108 also issuing into the inner expansion chamber 107 of body 101, but on the opposite side with respect to the first channel 106. A thin working diaphragm 109, which is subject to elastic deformation like that described with reference to FIGS. 1 to 4, is inserted and clamped between the first end portion 103 and the central portion 102 of body 101. Similar analogies are valid as to the engagement between the working diaphragm 109 and body 101.

The working diaphragm 109 is associated, at its side turned toward the second channel 108, with a small disc 110 made of electrically conductive material, while at its other side it is associated with an additional circular plate 111, substantially counter-shaped with respect to the working diaphragm 109. Both the small disc 110 and the additional circular plate 111 are directly in engagement with a calibrating spring 112 acting on the additional circular plate 111 and with a compression spring 113 acting on the small disc 110 and opposed to the preceding spring. The calibrating spring 112 bears against a calibrating headless screw 114 that can be screwed into the first channel 106 and that is centrally drilled, while the spring 113 is supported by a cup-shaped portion 115 obtained in a block with the central portion 102 of body 101. FIG. 5 shows that the cup-shaped portion 115 is joined to the central portion 102 by means of tabs 116 disposed spaced apart for example through 120°.

Substantially on the same cup-shaped portion 115 are engaged electrical contacts 117 crossing the central portion 102 and bent so that they can be arranged adjacent the small disc 110; and are made of electrically conductive material.

A second sinusoidal-shaped diaphragm 118 is clamped between the second end portion 104 and the central portion 102 of body 101. The second diaphragm 118 is a deformable diaphragm that sealingly encircles, together with the working diaphragm 109. An inner area or chamber 119 is disposed inside body 101 in which are located the electrical contacts 117 and the small disc 110, and separates the inner area or chamber 119 from an outer chamber 107 that communicates with channel 108.

Figure 5:
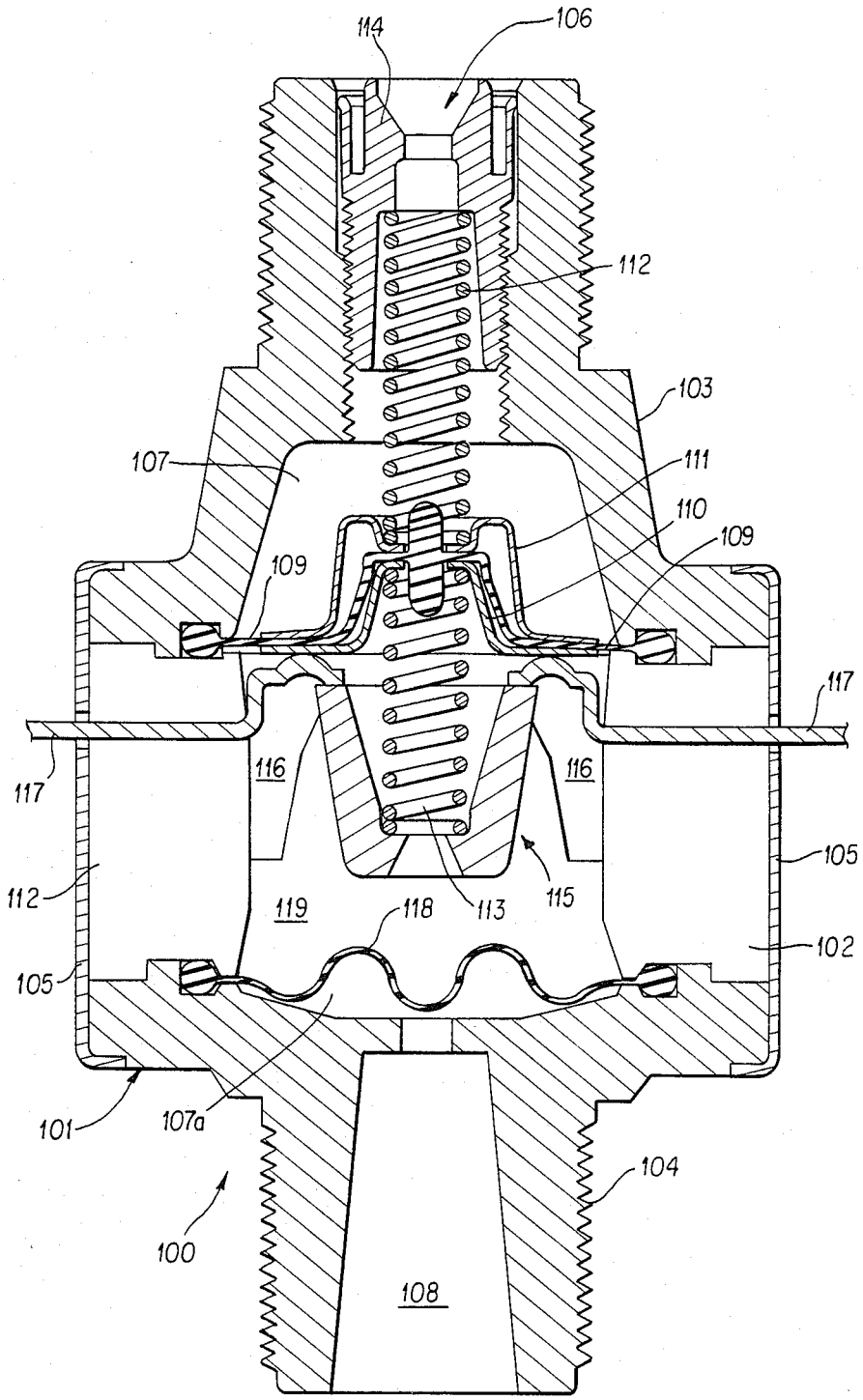
FIG. 5 is a sectional global view of a variant of the diaphragm pressure switch shown in FIGS. 1 to 4.
Figure 6:
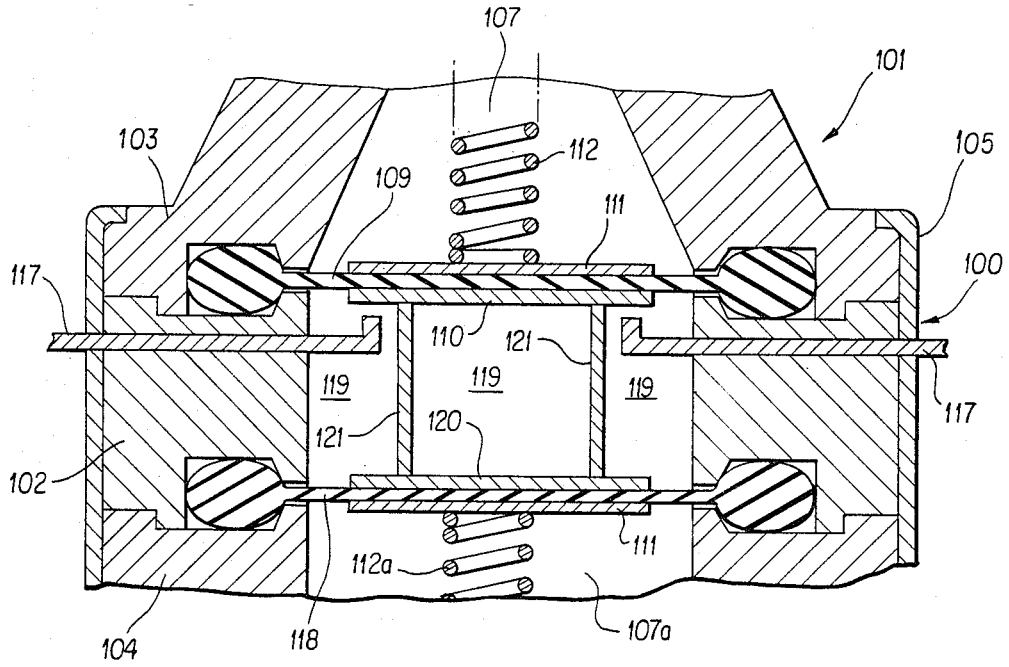
FIG. 6 is a diagrammatic view of a further embodiment of the pressure switch according to the invention.

According to a further embodiment of the pressure switch of the present invention, as shown in FIG. 6, the second diaphragm 118 may be similar in structure to the working diaphragm 109, that is, it may be flattened over a portion thereof. The switch illustrated by FIG. 6 may further include an additional circular plate 111 and a spring 112*a*. The spring 112*a* biases the additional plate 111 against diaphragm 118. As in the embodiment illustrated by FIG. 5, the second diaphragm 118 separates the inner area or chamber 119 from the outer chamber 107*a*.

As shown in FIG. 6, when diaphragms 109 and 118 are alike, it is advantageous to insert a frame integral to the small disc 110 at the inside of the inner area or chamber 119, which consists of a base plate 120 joined to the small disc 110 by means of spacers 121.

In both FIGS. 5 and 6 the inner area or chamber 119 of the inner expansion chamber 107 is substantially a sealed chamber that can be advantageously filled with any adapted fluid, particularly with a fluid that does not hinder, but on the contrary aids the passage of current between the electrical contacts 117 and the small disc 110, when the small disc lies on the contacts.

After the assembling, the body 101 exhibits an inner area or chamber 119 completely isolated from the fluid in which the pressure switch 100 works. The isolation of the inner area or chamber 119 from the working fluid is provided by the working diaphragm 109 and by the second diaphragm 118. In this inner area or chamber 119 are housed the members that are the most responsive to an unfavourable working environment: the electrical contacts 117 and the small disc 110. However the presence of this sealed inner area or chamber 119 does not hinder the work of the pressure switch as the variations in pressure act on the one hand directly on the working diaphragm 109 through the first channel 106, and on the other hand act on the same diaphragm 109 through the fluid present at the inside of the inner area or chamber 119.

This fluid can be of an incompressible type, such as some kinds of oils when the concerned pressures are rather high, or only air in the case of low pressures.

As a variant, the additional diaphragm 118 can be directly connected, as shown in FIG. 6, to the working diaphragm 109 by means of the above mentioned frame consisting of plate 120, spacers 121 and the same small disc 110. In this case, even with high pressure gradients, the inner area or chamber 119 is filled only with air, as obviously it can but have a constant volume.

As shown in FIG. 5, the calibration of the pressure switch 100 can be easily obtained by means of the calibrating headless screw 114 acting on the calibrating spring 112. The calibrating spring acts in the direction of the electrical contacts 117 with a great gradualness owing to the presence of spring 113, opposed to the calibrating spring 112. Both springs 112 and 113 can have such elastic constants that they keep steady the sensibility and the calibration of the pressure switch when varying the temperature of the environment in which the same is introduced, by counterbalancing the thermal expansion.

The invention attains the intended purposes. It should be pointed out that several practical tests have proved that the pressure switch of the invention is in a position to detect even very small pressures, that is in the range of about 1 to 2 millibars, in a very precise and constant manner.

The invention is susceptible of various modifications and variations without departing from the spirit and scope of the invention itself. For example, the spring 10 can be eliminated and contacts 8 and 117 can be variously arranged and also placed in both the chambers 5 and 6 or 107 and 119.

The above described pressure switch can also be mounted upside-down with respect to the position shown in the drawings and it can be provided on its outer surface with fixed engagement means such as for example tabs designed to be inserted into suitable ribs.

All details can be replaced by technically equivalent elements. Materials used as well as shapes and sizes can be whatever is desired according to the different requirements.

What is claimed is:

1. A diaphragm pressure switch for controlling small pressure gradients comprising, in a containing body communicating with the outside by means of channels: a diaphragm subject to elastic deformation, supported at its edges by said body and separating said channels from each other, at least a small disc made of electrically conductive material cooperatingly engaging a portion of one of the faces of said diaphragm, and electrical contacts supported by said body and disposed adjacent said small disc, characterized in that said diaphragm is provided with a working portion disposed outwardly from the periphery of said small disc and presenting a thin thickness, and in that means for supporting said diaphragm are provided and positioned in proximity to the working portion of the diaphragm and near one of the faces thereof and outwardly from the periphery of the small disc, the diaphragm supporting means being provided for preventing irregular deformations of said working portion.

2. A diaphragm pressure switch according to claim 1, characterized in that a central portion of said small disc contactingly engages said diaphragm and in that said diaphragm supporting means include an annular supporting lug projecting from said containing body and engaging said diaphragm close to the edge of said disc.

3. A diaphragm pressure switch according to claim 2, characterized in that the ratio between the diameter of said small disc and the inner diameter of said annular supporting lug is equal to or more than 0.9.

4. A diaphragm pressure switch according to claim 1, characterized in that said diaphragm has a thickness that gets gradually thinner from its centre towards the edge where an edge swelling is provided.

5. A diaphragm pressure switch according to claim 4, characterized in that said edge swelling is clamped and closely received between two contiguous portions of the body, the contiguous portions exerting pressure on the edge swelling to form a fluid seal therewith.

6. A diaphragm pressure switch according to claim 1, characterized in that said diaphragm is provided in the middle with a dome-shaped profile counter-shaped with respect to a central portion of said small disc and in that a compression spring is inserted into said central portion, the spring biasing said small disc in the direction of said diaphragm and being supported by a cup-shaped element engaged with said body.

7. A diaphragm pressure switch according to claim 6, characterized in that said cup-shaped element includes an outer surface having a screw-threaded portion and a sealing lip, each of the screw-threaded portion and sealing lip engaging said body and disposed within one of the channels.

8. A diaphragm pressure switch according to claim 1, characterized in that said body is defined by two half-shells engaged with each other by means of a pin and slot connection.

9. A diaphragm pressure switch according to claim 1, characterized in that a second diaphragm is inserted into said body and is engaged by the body itself so that, together with said working diaphragm, it sealingly isolates the inner area of said body where said small disc and said electrical contacts are housed.

10. A diaphragm pressure switch according to claim 9, characterized in that said body is divided into three portions and in that said working diaphragm is clamped between a central portion and one end portion of the body itself while said second diaphragm is clamped between said central portion and the second end portion thereof.

11. A diaphragm pressure switch according to claim 9, characterized in that said second diaphragm has a substantially sinusoidal-shaped section.

12. A diaphragm pressure switch according to claims 1 or 9, which further includes an additional circular plate and a calibrating spring, the spring biasing the additional circular plate in the direction of the electrical contacts, and a calibrating headless screw having a bore formed centrally therethrough, the headless screw being disposed within one of the channels formed in the body and supporting the calibrating spring within said one of the channels.

13. A diaphragm pressure switch according to claim 9, which further includes a rigid frame disposed within the inner area and cooperatively linked to the small disc, the frame being dimensioned to be closely received between the small disc and the second diaphragm to bias the working diaphragm and the second diaphragm sufficiently to provide each of the diaphragms with a substantially flattened cross-sectional shape.

* * * * *